US007622034B1

(12) United States Patent
Thakkar et al.

(10) Patent No.: US 7,622,034 B1
(45) Date of Patent: Nov. 24, 2009

(54) HYDROCARBON CONVERSION PROCESS

(75) Inventors: Vasant P. Thakkar, Des Plaines, IL (US); Douglas W. Kocher-Cowan, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 271 days.

(21) Appl. No.: 11/618,586

(22) Filed: Dec. 29, 2006

(51) Int. Cl.
*C10G 69/02* (2006.01)

(52) U.S. Cl. ..... 208/210; 208/46; 208/88; 208/89; 208/106; 208/107; 208/208 R; 208/209; 208/211

(58) Field of Classification Search ..... 208/46, 208/88–89, 106–107, 208 R, 209–211
See application file for complete search history.

(56) References Cited

U.S. PATENT DOCUMENTS

| | | | |
|---|---|---|---|
| 3,130,006 | A | 4/1964 | Rabo et al. |
| 3,974,060 | A | 8/1976 | Voorhies, Jr. et al. |
| 4,363,718 | A | 12/1982 | Klotz |
| 4,415,436 | A | 11/1983 | Angevine |
| 4,789,457 | A | 12/1988 | Fischer et al. |
| 4,943,366 | A | 7/1990 | Fischer et al. |
| 4,954,241 | A | 9/1990 | Kukes et al. |
| 5,114,562 | A | 5/1992 | Haun et al. |
| 5,203,987 | A | 4/1993 | de la Fuente |
| 5,382,349 | A | 1/1995 | Yoshita et al. |
| 5,403,469 | A | 4/1995 | Vauk et al. |
| 6,096,190 | A | 8/2000 | Cash |
| 6,179,995 | B1 | 1/2001 | Cash et al. |
| 6,224,747 | B1 | 5/2001 | Cash et al. |
| 6,294,079 | B1 | 9/2001 | Thakkar et al. |
| 6,294,080 | B1 | 9/2001 | Thakkar et al. |
| 6,312,586 | B1 | 11/2001 | Kalnes et al. |
| 6,315,889 | B1 | 11/2001 | Thakkar et al. |
| 6,379,535 | B1 | 4/2002 | Hoehn et al. |
| 6,444,116 | B1 | 9/2002 | Galiasso et al. |
| 6,514,403 | B1 | 2/2003 | Louie et al. |
| 6,547,956 | B1 | 4/2003 | Mukherjee et al. |
| 6,569,313 | B1 | 5/2003 | Carroll et al. |
| 6,689,273 | B1 | 2/2004 | Kalnes et al. |
| 6,702,935 | B2 | 3/2004 | Cash et al. |
| 6,783,660 | B2 | 8/2004 | Dahlberg et al. |
| 6,783,661 | B1 | 8/2004 | Briot et al. |

(Continued)

FOREIGN PATENT DOCUMENTS

| | | | |
|---|---|---|---|
| WO | 03038012 | A1 | 5/2003 |

(Continued)

*Primary Examiner*—Glenn A Caldarola
*Assistant Examiner*—Brian McCaig
(74) *Attorney, Agent, or Firm*—James C. Paschall

(57) ABSTRACT

A process is provided to produce high cetane quality and low or preferably ultra low sulfur diesel and a fluid catalytic cracker (FCC) quality feedstock from a processing unit including at least a hydrotreating zone and a hydrocracking zone. In one aspect, the processing unit includes reactor severity requirements in both the hydrotreating zone and the hydrocracking zone effective to produce the FCC feed quality and the diesel sulfur quality to permit a high quality hydrocracked product to be formed at lower pressures and conversion rates without overtreating the FCC quality feedstock stream. In another aspect, a portion of the hydrotreated effluent is selected for conversion in the hydrocracking and the remaining portion of the hydrotreated effluent is directed to subsequent processing, such as fluid catalytic cracking.

13 Claims, 1 Drawing Sheet

U.S. PATENT DOCUMENTS

| | | | | |
|---|---|---|---|---|
| 6,787,025 | B2 | 9/2004 | Mukherjee et al. | |
| 6,841,062 | B2 | 1/2005 | Reynolds | |
| 6,843,906 | B1 * | 1/2005 | Eng | 208/210 |
| 6,902,664 | B2 | 6/2005 | Timken | |
| 2003/0089637 | A1 | 5/2003 | Gueret et al. | |
| 2003/0089638 | A1 | 5/2003 | Gueret et al. | |
| 2005/0252830 | A1 | 11/2005 | Treesh et al. | |
| 2005/0284794 | A1 | 12/2005 | Davis et al. | |
| 2006/0118463 | A1 | 6/2006 | Colyar et al. | |
| 2006/0131212 | A1 | 6/2006 | Dahlberg et al. | |
| 2006/0196809 | A1 | 9/2006 | Mukherjee et al. | |

FOREIGN PATENT DOCUMENTS

| | | | |
|---|---|---|---|
| WO | 03080769 | A1 | 10/2003 |
| WO | 2005116171 | A2 | 12/2005 |

* cited by examiner

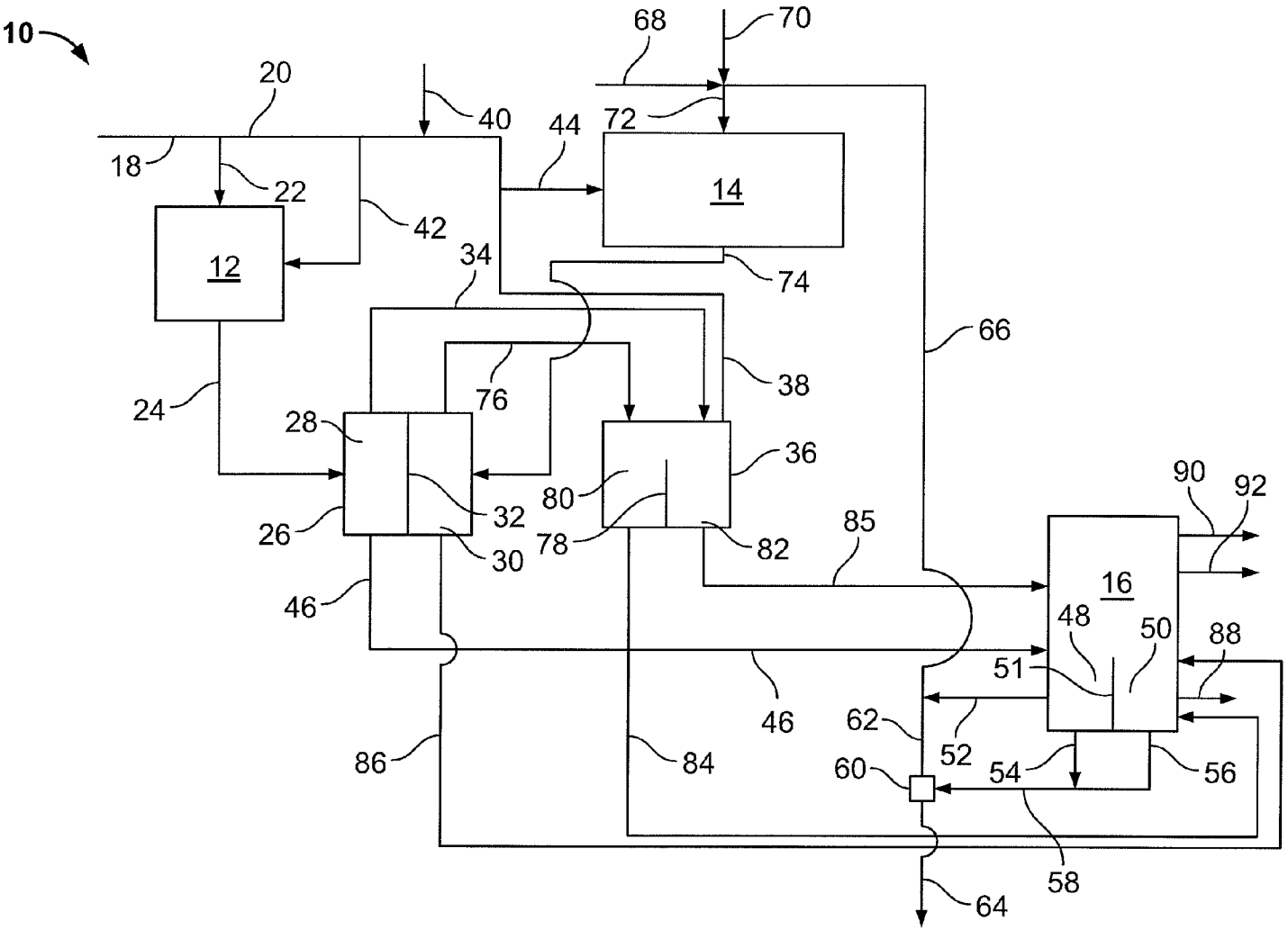
FIG.

HYDROCARBON CONVERSION PROCESS

FIELD

The invention relates to a hydrocarbon conversion process for the production of low or ultra low sulfur diesel and a high quality fluid catalytic cracker (FCC) feedstock. In particular, the invention relates to a process to hydrotreat and hydrocrack a hydrocarbonaceous feedstock to produce the low or ultra low sulfur diesel and the high quality FCC feedstock.

BACKGROUND

It has been recognized that due to environmental concerns and newly enacted rules and regulations, saleable petroleum products must meet lower and lower limits on contaminates, such as sulfur. New regulations require essentially complete removal of sulfur from liquid hydrocarbons that are used in transportation fuels, such as gasoline and diesel. For example, ultra low sulfur diesel (ULSD) requirements are typically less than about 10 ppm sulfur.

Fluid catalytic cracking (FCC) is a unit operation used by the petroleum industry to convert higher boiling hydrocarbons to more valuable products, such as gasoline. FCC feedstocks also have contaminants that require removal to meet environmental emission regulations and low sulfur product quality requirements for the FCC operation to be efficient and economical. For example, high levels of nitrogen and lower hydrogen content of the FCC feed is generally undesirable. High levels of nitrogen have undesired effects on the cracking catalysts, and lower hydrogen content results in higher severity operation and high coke formation in the FCC process. Hydrotreating or mild hydrocracking of the FCC feed allows the reduction of contaminants and increases the hydrogen content of the FCC feed. Typically mild hydrocracking may be used to pretreat the FCC feed and produce limited amounts of diesel. Unfortunately, the lower conversions in the mild hydrocracking usually results in lower quality diesel product. On the other hand, higher pressure operation is typically more expensive and usually results in overtreatment of the FCC feed.

Such dual requirements, as the desire to produce high quality diesel while not overtreating the FCC feed and efficient and economic use of hydrogen, often present a dilemma in attempting to set proper severity of operation. On one hand, there is interest in the use of lower conversion and lower pressure conditions to produce FCC quality feedstocks while, on the other hand, higher quality diesel production requires higher conversion and higher pressure. Mild hydrocracking conditions using moderate temperatures and pressures can produce FCC quality feedstocks having acceptable levels of sulfur and nitrogen. Such conditions typically may be used in less costly hydrocracking reactors that do not need to withstand high temperatures and pressures typical of more severe conditions. The mild hydrocracking conditions generally at lower conversion produce a lower quality product that generally does not meet the stringent ULSD requirements, but produces acceptable FCC feedstocks.

On the other hand, to achieve high quality product that meets ULSD levels, higher conversion rates and higher pressures can be employed. However, to remove sufficient quantities of sulfur and produce high quality product to meet ULSD levels, relatively high hydrogen pressures are generally required. Not only do such high hydrogen pressures require extensive capital investment in recycle gas compressors and other equipment, the high hydrogen pressures also result in FCC feedstocks that are overtreated with excessive hydrogen. Overtreated FCC feed is uneconomical to process because it can result in over cracking in the FCC unit producing lighter, lower boiling point products, rather than the desired gasoline or other desired hydrocarbon-based products.

Although a wide variety of process flow schemes, operating conditions and catalysts have been used in commercial petroleum hydrocarbon conversion processes, there is always a demand for new methods and flow schemes that provide economical operations to produce more useful products and improved product characteristics. In many cases, even minor variations in process flows or operating conditions can have significant effects on both quality and product selection. There generally is a need to balance economic considerations, such as capital expenditures and operational utility costs, with the desired quality of the produced products.

There is a continuing need, therefore, for improved and cost effective methods to produce hydrocarbon streams that meet increasingly stringent products requirements. In particular, there is a need to provide both FCC quality feedstocks and high quality (cetane) ULSD from hydrocarbonaceous streams in a cost effective and efficient manner.

SUMMARY

A process is provided to produce high quality, low sulfur diesel and a fluid catalytic cracker (FCC) feedstock from a processing unit including at least a hydrotreating zone and a hydrocracking zone. In one aspect, the processing unit decouples the reactor severity requirements for the FCC feed quality and the diesel sulfur quality to provide a high quality hydrocracked product formed at lower pressures and conversion rates without overtreating the FCC quality feedstock stream. In other words, the hydrotreating zone is operated at conditions effective to produce a hydrocarbonecous stream having a quality suitable for FCC and the hydrocracking zone, which receives a hydrocarbonaceous stream downstream the hydrotreating zone, is operated at conditions effective to produce the ultra low sulfur diesel without having to overtreat FCC quality feedstock. In another aspect, these products are obtained in the processing unit by hydrotreating a vacuum gas oil (VGO) feedstock to produce an effluent meeting FCC feed quality requirements and then hydrocracking a portion of the hydrotreated feed at higher conversions to produce high cetane quality (greater than about 40, and preferably about 40 to about 55) and low sulfur diesel, and preferably, ultra low sulfur diesel having less than 10 ppm sulfur.

In general, the hydrotreating zone is operated at a temperature from about 288° C. (550° F.) to about 454° C. (850° F.), a pressure from about 3.5 MPa (500 psig) to about 17.3 MPa (2500 psig), and a liquid hourly space velocity from about 0.1 $hr^{-1}$ to about 10 $hr^{-1}$. The hydrocracking zone is operated at a temperature range from about 288° C. (550° F.) to about 454° C. (850° F.), a pressure range from about 3.5 MPa (500 psig) to about 17.3 MPa (2500 psig), a liquid hourly space velocity (LHSV) from about 0.1 to about 10 $hr^{-1}$, and a hydrogen circulation rate from about 84 normal $m^3/m^3$ (500 standard cubic feet per barrel) to about 4200 $m^3/m^3$ (25,000 standard cubic feet per barrel).

In one aspect, the process reacts a hydrocarbonaceous feedstock in a hydrotreating zone containing a hydrotreating catalyst to produce a hydrotreating zone effluent having reduced concentrations of sulfur and nitrogen to meet the FCC quality requirements. The hydrotreating effluent is then separated in a fractionation zone into at least a diesel boiling range hydrocarbon fraction (a hydrocarbonaceous stream generally having a boiling point of about 140° C. (300° F.) to about 382° C. (720° F.)) and the FCC quality feedstock fraction (a heavier hydrocarbonaceous stream generally having higher boiling points). The diesel boiling range hydrocarbon fraction generally has a reduced concentration of sulfur (generally about 100 to about 2000 ppm) as compared to the incoming hydrocarbonaceous feedstock (generally about 0.1 to about 4 percent sulfur), but is not yet at low or ultra low levels that require less than about 10 ppm.

The process provides for the selection of at least a first portion of the FCC quality feedstock (unconverted oil), in one aspect about 25 to about 40 percent, for combination with the diesel boiling range hydrocarbon fraction to form a feedstock that is fed to a hydrocracking zone. The hydrocracking zone has at least a hydrocracking catalyst and is operated at higher conversion, preferably about 70 to about 85 percent, on a smaller portion of the initial hydrocarbonaceous feed to convert to the high quality diesel boiling range hydrocarbon stream with low or ultra low sulfur levels. The hydrocracking zone effluent is then passed into a fractionation zone to separate the high cetane quality (greater than about 40, and preferably about 40 to about 55) low or ultra low sulfur diesel and the remaining portion of the hydrocracking zone effluent suitable for FCC feedstock. In one such aspect, these conditions result in a total conversion rate of the VGO hydrocarbonaceous feedstock of about 33 to about 45 percent; in other aspects, the total VGO conversion rate may be increased or decreased depending on the desired process output by, among other adjustments, increasing or decreasing the amount of FCC stock selected for the hydrocracking zone feedstock.

In another aspect, the process preferably employs a divided wall fractionator providing a first fractionation region for generally fractionating the hydrotreating zone effluent and a second fractionation region for generally fractionating the hydrocracking zone effluent. Preferably, the divided wall fractionator includes a dividing wall arranged and configured to substantially prevent the admixture of the diesel boiling range hydrocarbon stream from the hydrotreating zone effluent and the low or ultra low sulfur diesel from the hydrocracking zone effluent, and allows the movement of vapor from each fractionation region to an upper end of the fractionator for removal from the fractionator.

Other embodiments encompass further details of the process, such as preferred feedstocks, preferred hydrotreating catalysts, preferred hydrocracking catalysts, and preferred operating conditions to provide but a few example. Such other embodiments and details are hereinafter disclosed in the following discussion of various aspects of the process.

BRIEF DESCRIPTION OF THE DRAWING FIGURE

The drawing FIGURE is a simplified process flow diagram of a preferred embodiment of the processes described herein. The description of the drawing FIGURE below is intended to be schematically illustrative of the present invention and is not intended to be a limitation thereof.

DETAILED DESCRIPTION

A hydrotreating and hydrocracking process is provided to convert a hydrocarbonaceous feedstock, such as a VGO feedstock, containing high boiling range hydrocarbons into a diesel range boiling hydrocarbons meeting low or ultra low sulfur requirements and a FCC quality feedstock within the same processing unit. Generally, the hydrocarbonaceous feedstock contains high boiling range hydrocarbons that boil in a range greater than a light cycle oil (LCO). A preferred feedstock is a VGO, which is typically recovered from crude oil by distillation. A VGO hydrocarbon stream generally has a boiling range between about 315° C. (600° F.) and about 565° C. (1050° F.) with at least 50 percent by weight of its hydrocarbon components boiling above 371° C. (700° F.). Optionally, the process also provides for hydrocracking a second hydrocarbonaceous feedstock containing a hydrocarbonaceous stream with a boiling point generally between about 343° C. (650° F.) and about 566° C. (1050° F.).

VGO feedstocks may also contain undesired contaminates, such as between about 0.1 to about 4 percent sulfur and between about 300 and about 4000 ppm nitrogen. To render such feedstocks suitable for fuels and downstream processing units, the levels of sulfur and other contaminates are reduced. Common hydrotreating techniques can reduce the sulfur and other contaminates to a level sufficient for FCC feedstock, but preferred operating conditions still produce diesel boiling range hydrocarbons that contain relatively high sulfur levels (i.e., about 200 to about 1000 ppm) that reduce their utility in the production of ultra low sulfur diesel. In addition, these diesel boiling range hydrocarbons also may have relatively low cetane numbers, which must also be improved for the production of high quality diesel fuel. The methods described herein, therefore, provide a processing unit for providing high quality ULSD and FCC quality feedstocks without overtreating the lower boiling hydrocarbons.

In one aspect, the process provides a hydrotreating zone operating to reduce the levels of sulfur and other contaminates in the VGO or other hydrocarbonaceous feedstocks to FCC feedstock quality levels. The feedstock is introduced into the hydrotreating zone together with an amount of hydrogen effective to carry out the hydrotreating reactions to reduce the levels of sulfur to about 200 to about 1000 ppm. The feedstock/hydrogen admixture is contacted with a suitable catalyst at hydrotreating conditions in order to reduce the level of contaminates in the hydrocarbonacous stream to generally meet desired levels of sulfur, nitrogen and hydrogenation for a FCC quality feedstock. For example, the hydrotreating reaction zone may produce an effluent having a reduced concentration of sulfur (about 200 to about 1000 ppm), a reduced concentration of nitrogen (about 200 to about 600 ppm), and a hydrogen content of about 11.5 to about 12.5 percent. The contaminate reduction will depend on a variety of factors such as the quality of the feedstock, the hydrotreating conditions, the available hydrogen, and the hydrotreating catalyst, among others.

The hydrotreating zone in one aspect operates at relatively mild conditions generally not over about 454° C. (850° F.) and 17.3 MPa (2500 psig) in order to minimize overtreating the higher boiling hydrocarbons. In general, the hydrotreating reaction zone operates at a temperature from about 288° C. (550° F.) to about 454° C. (850° F.), a pressure from about 3.5 MPa (500 psig) to about 17.3 MPa (2500 psig), and a liquid hourly space velocity from about 0.1 $hr^{-1}$ to about 10 $hr^{-1}$.

For purposes herein, "hydrotreating" refers to a processing zone where a hydrogen-containing treat gas is used in the presence of suitable catalysts that are primarily active for the removal of heteroatoms, such as sulfur and nitrogen. The hydrotreating zone may contain a single or multiple reactors (preferably trickle-bed reactors) and each reactor may contain one or more reaction zones with the same or different catalysts.

Suitable hydrotreating catalysts for use herein are any known conventional hydrotreating catalyst and include those that are comprised of at least one Group VIII metal (preferably iron, cobalt and nickel, and more preferably cobalt and/or nickel) and at least one Group VI metal (preferably molybdenum and tungsten) on a high surface area support material, preferably alumina. Other suitable hydrotreating catalysts include zeolitic catalysts, as well as noble metal catalysts where the noble metal is selected from palladium and platinum. It is within the scope herein that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Of course, the particular catalyst compositions and operating conditions may vary depending on the particular hydrocarbons being treated and other parameters.

In one aspect, the resulting effluent from the hydrotreating zone is introduced into a separation zone, and in one such aspect, a hot high pressure separator (HHPS). In the separation zone, entrained or other hydrocarbonaceous vapor components are separated from the liquid phase components of the effluent. As further discussed below, the HHPS may include one or more regions divided by walls or other dividers to form a plurality of separation regions to substantially prevent admixture between the hydrotreating effluent and other processing streams being separated in the HHPS. For example, the divided wall separator generally may prevent subsequently formed low or ultra low sulfur diesel from mixing with hydrocarbonaceous streams with higher levels of sulfur.

In this aspect, the effluent from the hydrotreating zone is preferably introduced into one of the separation regions in the HHPS, which separates a first hydrocarbonaceous vapor stream including hydrogen, hydrogen sulfide, and ammonia and a first hydrocarbonaceous liquid stream having a reduced concentration of sulfur (i.e., about 200 to about 1000 ppm). By one approach, the HHPS is operated at a temperature from about 149° C. (300° F.) to about 280° C. (550° F.) and a pressure from about 3.5 MPa (500 psig) to about 17.3 MPa (2500 psig) to form the first vaporous hydrocarbonaceous stream and the first liquid hydrocarbonaceous stream.

The first vaporous stream may then be cooled, partially condensed, and introduced into a cold vapor liquid separator. Thereafter, hydrogen sulfide and ammonia may be separated, and the hydrogen may be recovered and recycled back to the hydrotreater and/or hydrocracker reaction zones as part of the hydrogen make-up streams. The cold separator will be further described below.

The first liquid hydrocarbonaceous stream from the HHPS is then introduced to a fractionation zone where at least a diesel boiling range hydrocarbon fraction having a boiling point of about 149° C. (300° F.) to 371° C. (700° F.), and a sulfur content of about 200 to about 1000 ppm is formed as a side cut stream. Optionally, the liquid hydrocarbonaceous stream also may be processed through one or more flash drums or other separators prior to the fractionation zone. The diesel side cut stream generally is not considered as having low or ultra low sulfur. Accordingly, for purposes herein, this first diesel side cut will be referred to as the "dirty" diesel hydrocarbon stream as it requires further processing to achieve low or ultra low sulfur levels.

In one aspect of the process, the fractionation zone comprises a divided-wall fractionator, such as those disclosed in U.S. Pat. No. 6,379,535 to Hoehn et al., which is hereby incorporated herein by reference in its entirety. The divided-wall fractionator in one aspect is constructed with a solid dividing wall or other partition located in a lower portion of the fractionator to provide two distinct fractionation regions. In one aspect, the dividing wall is arranged and configured to substantially reduce, or substantially prevent, the admixture of the dirty diesel hydrocarbon stream with other product streams in other fractionation regions, while permitting the movement of vapor from one or more fractionation regions to an upper portion of the fractionator. In some instances, the liquid volumetric flow rates may be unequal in the two zones; therefore, it is preferred that the fractionation region having the lower flow rate be proportionally smaller than a region having a relatively high flow rate in order to efficiently utilize the total volume available in the lower portion of the fractionator.

The feed streams to the divided-wall fractionator may be introduced at a convenient place or elevation of the fractionator (including either above or below the upper end of the dividing wall) in order to effect the desired fractionation, separation, and product generation. In one aspect, the first liquid hydrocarbonaceous stream from the HHPS is introduced at a location below the upper end of the dividing wall in one of the fractionation regions. In this manner, cross-contamination of this feed stream containing dirty diesel and other process streams, such as streams containing ULSD, is substantially reduced and, preferably prevented.

Other fractionation procedures also may be used, such as the use of separate fractionators, other multi-zone fractionators, or other fractionation/separation approaches that will substantially reduce or prevent the cross-contamination of reactant streams.

In yet another aspect, the fractionation zone operates to provide a cut that includes unconverted oil (UCO), which preferably comprises the higher boiling components having the desired sulfur, nitrogen, and hydrogen contents discussed above that are suitable for FCC. As a result, such a cut forms an FCC quality feedstock. In another aspect, each region of the divided wall fractionator provides a cut having UCO suitable for FCC feedstocks, and each cut is preferably combined into a single hydrocarbonaceous stream suitable as an FCC feedstock. As will be further discussed below, a portion of this FCC quality feedstock is selected for further processing in a hydrocracking zone in order to produce ULSD.

In one aspect, to produce diesel boiling range hydrocarbons having the low or ultra low levels of sulfur and an improved cetane number, a hydrocracking zone is employed in the processing unit. For purposes herein, "hydrocracking" refers to a processing zone where a hydrogen containing treat gas is used in the presence of suitable catalysts that are primarily active for the breaking of carbon bonds to form saturated hydrocarbons. However, rather than hydrocracking the entire effluent from the hydrotreating reaction zone, which can over process higher boiling components, only a selected portion of the products from the fractionation zones are introduced to the hydrocracking zone. Therefore, only a smaller portion of the feed is hydrocracked at higher conditions to produce high quality diesel (cetane numbers greater than 40) with low, and preferably, ultra low sulfur diesel. Moreover, the lower amount of feed to the hydrocracking zone and less severe conditions are also advantageous because they generally permit the use of smaller, less expensive reaction vessels.

In one aspect of the hydrocracking zone, a feedstock is provided comprising a selected portion of the UCO fraction from the fractionation zone (or comparable source) that is combined with the dirty diesel side cut fraction from the fractionator zone. In one such aspect, about 25 to about 40 percent of the UCO fraction is combined with the dirty diesel hydrocarbon stream and directed to the hydrocracking zone. Such portion is selected to achieve a total conversion rate of the VGO hydrocarbonaceous feedstock of about 33 to about 45 percent, which is achieved through about a 15 percent conversion rate of the VGO feedstock in the hydotreating zone and about a 70 to about 85 percent conversion rate of the UCO portion and dirty diesel in the hydrocracking zone. The selected portion of the UCO fraction also may vary depending on the composition of the various hydrocarbon streams, the desired and actual conversion rates in the hydrocracking zone, the feedstock composition needed for FCC, and other processing considerations.

By selecting only a portion of the UCO fraction/FCC quality feedstock for combination with the dirty diesel flow and further processing through a hydrocracking zone, the processes described herein provide considerable flexibility in producing both high quality ULSD and FCC feedstocks. The conversions in the hydrocracking reaction zone and the amount of and proportion of the UCO fraction relative to the dirty diesel flow in the combined stream may be varied and/or adjusted as needed to achieve desired quality levels in both the ULSD flow and FCC feedstock.

In one aspect, the hydrocracking zone may contain one or more beds of the same or different catalysts. In one such aspect, the preferred hydrocracking catalysts utilize amorphous bases or low-level zeolite bases combined with one or more Group VIII or Group VIB metal hydrogenation components. In another aspect, the hydrocracking zone contains a catalyst which comprises, in general, any crystalline zeolite cracking base upon which is deposited a minor proportion of a Group VIII metal hydrogenating component. Additional hydrogenation components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms.

It is preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms, wherein the silica/alumina mole ratio is about 4 to 6. An example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 to Rabo et al., which is hereby incorporated herein by reference in its entirety.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least about 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII (i.e., iron, cobalt, nickel, ruthenium, rhodium, palladium, osmium, iridium and platinum). In addition to these metals, other promoters may also be employed in conjunction therewith, including the metals of Group VIB (e.g., molybdenum and tungsten). The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 weight percent.

The preferred method for incorporating the hydrogenating metal is to contact the zeolite base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like, if desired, and calcined in air at temperatures of, e.g., about 371° to about 648° C. (about 700° to about 1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and about 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz), which is hereby incorporated herein by reference in its entirety.

In one aspect of the process, the feedstock for the hydrocracking zone is exposed to hydrogen and is contacted with the hydrocracking catalyst at hydrocracking conditions to achieve conversion levels between about 70 and about 85 percent to form an effluent including the low and preferably ultra low sulfur diesel (i.e., less than about 10 ppm sulfur) with an improved cetane number (i.e., about 40 to about 55). However, other conversion levels also may be used depending on the content of the feedstock to the hydrocracking zone, the flowrates through the zone, the catalyst systems and hydrocracking conditions, and the desired product qualities among other considerations. In one aspect, the operating conditions to achieve such conversion levels include a temperature range from about 288° C. (550° F.) to about 454° C. (850° F.), a pressure range from about 3.5 MPa (500 psig) to about 17.3 MPa (2500 psig), a liquid hourly space velocity (LHSV) from about 0.1 to about 10 $hr^{-1}$, and a hydrogen circulation rate from about 84 normal $m^3/m^3$ (500 standard cubic feet per barrel) to about 4200 $m^3/m^3$ (25,000 standard cubic feet per barrel). The hydrocracking conditions may be varied and are selected on the basis of the feedstock composition and desired ULSD characteristics and amounts, as well as the nature and composition of the UCO/ FCC portion used to provide the hydrocracking feedstock.

In another aspect, the hydrocracking reaction zone preferably contains a hydrotreating zone with a hydrotreating catalyst upstream of the hydrocracking catalyst to catalytically remove nitrogen and sulfur from the hydrocarbonaceous feedstock prior to the hydrocracking. Any suitable hydrotreating and/or hydrodesulfurization catalyst may be employed. Such hydrotreating in the hydrocracking reaction zone may be operated at conditions which generally fall within the preferred operating conditions of the hydrocracking step (as discussed above) and may be selected depending upon the composition and nature of the particular feedstock subject to hydrocracking. In yet another aspect, the hydrocracking reaction zone also preferably includes a post treat zone having a suitable catalyst downstream of the hydrocracking catalyst to post treat any naphtha range hydrocarbons to break down recombinant mercapton sulfur so that naphtha can also meet lower levels of sulfur and nitrogen required for reformer feed quality. The post treat catalyst zone space velocity may be about 1 to about 30 $hr^{-1}$. The hydrotreating zone and post treat zone may be provided in one or more separate reaction vessels or may be combined in reaction vessels with the hydrocracking catalyst.

The resulting effluent from the hydrocracking zone is then preferably introduced into a separation zone, and in particular, into a hot and/or cold high pressure separators to separate a vaporous hydrocarbonaceous phase from the liquid phase of the effluent. In one aspect, the hydrocracking reaction zone effluent may be separated in one region of the above-described divided-wall hot HHPS to produce a second vaporous hydrocarbonaceous stream including hydrogen and reduced levels of hydrogen sulfide and ammonia and a second liquid hydrocarbonaceous stream having the low or ultra low levels of sulfur produced in the hydrocracking zone. As mentioned previously, the divided wall HHPS substantially prevents the admixture of the effluent from the above-mentioned first hydrotreating zone and the effluent from hydrocracking reaction zone.

The second vaporous stream from the HHPS is then preferably directed to the cold high pressure separator (CHPS) along with the previously described first vaporous stream from the other zone of the HHPS. The CHPS operates at a temperature from about 16° C. (60° F.) to about 71° C. (160° F.) and a pressure from about 3.5 MPa (500 psig) to about 17.3 MPa (2500 psig) to separate out a hydrogen-rich gaseous stream and at least two liquid hydrocarbonaceous streams (one that contains low or ultra low levels of sulfur and the other containing higher levels of sulfur). To this end, the CHPS also includes at least a partial dividing wall to segregate the resulting liquids from the hydrotreating and hydrocracking zones as further discussed below in conjunction with the drawing figure.

If desired, the resulting hydrogen-rich gaseous stream from the CHPS may be compressed and then recycled to the hydrotreating and/or the hydrocracking zones as part of the hydrogen make-up streams. The liquid hydrocarbonacous streams from the CHPS are preferably routed through one or more flash drums and then directed back to a fractionation zone. As discussed further below in conjunction with the drawing figure, in one aspect, each liquid stream from the CHPS is preferably introduced into one of the regions of the above-mentioned divided wall fractionator based on the relative quality and sulfur content of the stream.

The second liquid hydrocarbonacous stream from the HHPS contains the low or ultra low sulfur diesel and is also preferably routed through one or more flash drums and back to the fractionation zone where the low or ULSD is then separated out as a side cut stream. Similar to CHPS discussed above, each of the first and second liquid streams from the HHPS are introduced into different regions of the divided wall fractionator based on their relative contents of sulfur. In yet other aspects of the process, one or more separate HHPS systems may be substituted for the above mentioned divided-wall HHPS. Similarly, one or more separate CHPS systems may be used to separate the above mentioned vaporous and liquid streams.

As discussed above, the fractionation zone is operated to produce at least the ULSD, the dirty diesel hydrocarbons, and the bottoms UCO/FCC quality feedstock stream. However, it will be appreciated by one skilled in the art that the fractionation zone may also produce other hydrocarbon products, such as naphtha boiling range hydrocarbons, kerosene boiling hydrocarbons, and other product fractions. In other aspects, separate fractionators and/or fractionation columns may be used for each product stream from the HHPS and/or CHPS.

DETAILED DESCRIPTION OF THE DRAWING

Turning to the FIGURE, an exemplary hydrocarbon processing unit to provide both an FCC quality feedstock and ULSD will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to the FIGURE, an exemplary processing unit 10 is illustrated that includes at least a hydrotreating reaction zone 12, a hydrocracking reaction zone 14, and a fractionation zone 16 to provide the FCC quality feed stock in stream 64 and the ULSD in stream 88. As discussed above, the processing unit 10 is configured to produce both a high-quality, low or ULSD having a cetane number of about 40 to about 55 with less than 10 ppm sulfur and a FCC quality feedstock having about 200 to 1000 ppm sulfur, about 200 to about 600 ppm nitrogen, and about 11.5 to about 12.5 percent hydrogen by decoupling the reactor severity requirements needed to achieve both process streams. In other words, the hydrotreating zone 12 is operated at conditions effective to produce a hydrocarbonecous stream having a quality suitable for FCC and the hydrocracking zone 14 is operated at conditions effective to produce the ultra low sulfur diesel having less than 10 ppm sulfur without having to overtreat the FCC quality feedstock. By one approach, a feedstock, in one aspect containing VGO, is introduced to the process 10 via line 18 and admixed with a hydrogen-rich recycle gas provided by line 20. The resultant admixture is transported via line 22 into the hydrotreating zone 12, which can be one or more reaction vessels operating under hydrotreating conditions to reduce the levels of sulfur in the feedstock to about 200 to about 1000 ppm, the levels of nitrogen to about 200 to about 600 ppm, and a hydrogen content of about 11.5 to about 12.5 percent. The hydrotreating reaction zone 12 operates with a severity sufficient to produce an effluent generally suitable as an FCC quality feedstock, but not necessarily ULSD The resulting effluent from the hydrotreating reaction zone 12 is carried via line 24 and introduced into a hot high pressure separator 26. Preferably, the separator 26 is a divided-wall separator that includes at least zone 28 and zone 30 that are separated by a dividing wall 32. The divided wall separator 26 substantially prevents the admixture of the effluent from the hydrotreating zone 12, which preferably has reduced but not ultra low levels of sulfur, with the effluent from the hydrocracking zone 14, which preferably has ultra low levels of sulfur and which is also introduced into the separator 26 as described hereinafter.

A first vaporous hydrocarbonaceous stream is removed from the separator 26 via line 34 and is introduced into a cold high pressure separator 36. A hydrogen-rich gaseous stream is removed from the cold high pressure separator 36 via line 38. The hydrogen-rich gaseous stream is preferably introduced into an appropriate stripper or absorption unit (not shown) to remove unwanted sulfur and nitrogen components to produce a hydrogen-rich gaseous stream having a reduced concentration of hydrogen sulfide and ammonia that is admixed with a hydrogen make-up stream 40. The hydrogen-rich gaseous stream can also optionally be introduced into the hydrotreating zone 12 and the hydrocracking zone 14 via lines 42 and 44, respectively.

A first liquid hydrocarbonaceous stream is removed from the separator 26 via line 46 and introduced into the fractionation zone 16. As discussed above, the fractionation zone 16 preferably includes a divided wall fractionator with at least a first zone 48 and a second zone 50 segregated by a dividing wall 51 that substantially prevent the admixture of the effluent portions from the hydrotreating zone 12 (which has reduced but not ultra low levels of sulfur) and the effluent portions from the hydrocracking zone 14 (which has ultra low levels of sulfur). By one approach, the line 46 carrying the first liquid stream from the separator 26 is introduced into zone 48 of the divided wall fractionator 16. The fractionator 16 then separates at least a diesel boiling range cut via line 52 (i.e., the above described dirty diesel stream) and a heavier or generally unconverted oil cut via the bottoms of the fractionator 16 through line 54. Thereafter, line 54 is combined in line 58 with a hereinafter described bottoms unconverted oil cut separated from the fractionator zone 50 via line 56.

A portion of the unconverted oil in line 58 is selected 60 for further processing in the hydrocracking zone 14. By one approach, the unconverted oil in line 58 is portioned into the line 62 and into line 64, which is directed to a downstream processing unit and preferably a FCC (not shown). As discussed above, it is preferred that line 62 include about 33 to about 45 percent of line 58. The selected portion of the unconverted oil in line 62 is then combined with the diesel boiling range hydrocarbon cut in line 52 (i.e., the above described dirty diesel) and then transported via line 66 to the hydrocracking zone 14. Prior to introduction to the hydrocracking zone, the hydrocarbons in line 66 may be admixed with a hydrogen-rich recycle gas via line 68, and optionally, also admixed with a second hydrocarbonaceous feedstock via line 70. These combined streams are then introduced through line 72 into the hydrocracking zone 14, which as discussed above may include a hydrotreating zone, a hydrocracking zone, and a post treat zone operating at conditions to produce a hydrocracking zone effluent including the low and preferably ultra low sulfur (i.e., preferably less than about 10 ppm sulfur) and an improved cetane number (i.e., about 40 to about 55).

The resulting effluent from the hydrocracking zone 14 is then transported by line 74 into the hot high pressure separator 26, and preferably, into zone 30 thereof so as to not admix the low or ULSD in the hydrocracking effluent with the effluent from the hydrotreating zone 12, which generally includes higher levels of sulfur. A second vaporous hydrocarbonaceous stream is removed from the separator 26 via line 76 and is introduced into the cold high pressure separator 36. Any hydrogen in line 76 will be separated and removed from the cold high pressure separator 36 via line 38 as described above.

The cold pressure separator 36 also preferably has at least a partial dividing wall 78 that segregates the separator 36 into zones 80 and 82 to minimize and substantially prevent the admixture of the respective effluent portions of the hydrotreating zone 12 and the hydrocracking zone 14. As a result, the cold separator 36 preferably separates at least two liquid streams from the incoming first and second vapor streams of lines 34 and 76. For example, one liquid hydrocarbonaceous stream containing the ULSD generally accumulates in zone 80 of the divided wall separator 36 and transported via line 84 into the fractionator, and preferably zone 50 thereof. Another liquid hydrocarbonaceous stream generally containing higher levels of sulfur is accumulated in zone 82 and transported via line 85 into the fractionation zone 16, and preferably zone 48 thereof. In this manner, the dividing wall 78 generally keeps the condensate from the vaporous portions of the hydrotreating effluent and the hydrocracking effluent (as separated in the HHPS 26) segregated so that the ULSD is not contaminated with streams having higher levels of sulfur or other contaminates.

Referring again to the hot high pressure separator 26, a second liquid hydrocarbonaceous stream containing ULSD from the hydrocracking zone 14 is separated (preferably in zone 30 of the separator 26) and transported via line 86 into the fractionation zone 16, and preferably zone 50 thereof. The fractionator zone 50 then separates ULSD via line 88 and an unconverted oil from the bottoms thereof via the previously discussed line 56. In this exemplary configuration, zone 48 of the fractionator preferably includes hydrocarbons having higher levels of sulfur (i.e., about 50 to about 200 ppm) and zone 50 of the fractionator preferably includes hydrocarbons having low or ultra low levels of sulfur (i.e., preferably less than about 10 ppm). It will be appreciated that the fractionation zone 16 may also separate other hydrocarbonaceous streams, such as, for example, a naphtha boiling range hydrocarbon cut via line 90 and/or a kerosene boiling range hydrocarbon cut via line 92. There, of course, may be other products separated from the fractionation zone 16.

Advantages and embodiments of the process described herein are further illustrated by the following example. The particular amounts, conversion rates, and flowrates recited in this example, as well as other conditions and details, should not be construed to limit the scope of the processes described herein. It will be appreciated that these flowrates and conversion rates are only exemplary and not intended to limit the use of the processes described herein to such conditions.

EXAMPLE

The cases below illustrate various flowrates and conversion levels in the hydrocracker and hydrotreater as well as their effect on the production of ULSD and cetane numbers. For clarity, the various flowrates are related to exemplary process flow streams in the attached drawing FIGURE.

TABLE 1

Exemplary Process Conditions.

| Description | Case 1 | Case 2 | Case 3 |
|---|---|---|---|
| VGO Feedstock (e.g., line 18) | 240 kbpsd | 240 kbpsd | 240 kbpsd |
| UCO selected for hydrocracking | 0 kbpsd | 61.7 kbpsd | 84.7 kbpsd |

TABLE 1-continued

Exemplary Process Conditions.

| Description | Case 1 | Case 2 | Case 3 |
|---|---|---|---|
| (e.g. line 62) | | | |
| UCO selected as FCC feedstock (e.g., line 64) | 204 kbpsd | 160.8 kbpsd | 132.0 kbpsd |
| Portion of UCO selected for hydrocracking | 0% | 27.7% | 39.1% |
| Total Conversion of VGO Feedstock | 15% | 33% | 45% |
| Converted product | 36 kbpsd | 79.2 kbpsd | 108 kbpsd |

TABLE 2

Exemplary Process Conditions.

| Description | Case 1 | Case 2 | Case 3 |
|---|---|---|---|
| Hydrotreating Zone Conversion Rate | 15% | 15% | 15% |
| Hydrocracking Zone Conversion Rate | 0% | 70% | 85% |
| Sulfur Content (e.g., line 88), ppm | 100 | <10 | <10 |
| Cetane Number (e.g., line 88) | <40 | 45-50 | 50-55 |

Thus, in this aspect, the process of the reactions can be illustrated by the following relationships:

$$Q_{CO}=(Q_{INPUT})(C_{HT})+(Q_{HC})(C_{HC})$$

Where the dirty diesel component in the feed stream to the hydrocracking zone ($Q_{HC}$) is dependent on the hydrotreating zone outputs (($Q_{INPUT}$) ($C_{HT}$)). And, the total flowrate of feed stream to the hydrocracking zone ($Q_{HC}$) is determined by the dirty diesel flow to the hydrocracking zone and the amount of the UCO provided to the hydrocracking zone ($Q_{UCO}$). Additionally, in this aspect, the flowrate of UCO that is selected for hydrocracking feed stream and conversion in the hydrocracking zone can be generally determined by the following formula:

$$Q_{UCO}=(Q_{CO}-(Q_{INPUT})(C_{HT}))/(C_{HC})$$

where:

$Q_{INPUT}$=the flowrate of the input hydrocarbonaceous stream;

$Q_{CO}$=the flowrate of converted product desired;

$C_{HT}$=conversion rate in the hydrotreating zone;

$C_{HC}$=conversion rate in the hydrocracking zone;

$Q_{HC}$=the total flowrate to the hydrocracking zone; and $Q_{UCO}$=flowrate of the UCO (FCC quality) portion to the hydrocracking zone.

Case 1 provides an example of no hydrocracking of the dirty diesel fraction and UCO fraction (i.e., $Q_{HC}$ and $Q_{UCO}$ are substantially zero) In this case, a 15 percent conversion in the hydrotreating zone is achieved, and generally results in an unacceptable diesel product with high sulfur and low cetane numbers as shown in table 2. In cases 2 and 3, about 27 percent and about 40 percent, respectively, of the FCC quality UCO is provided as part of the feedstock (with the dirty diesel fraction) to the hydrocracking zone to provide an acceptable diesel product with a total conversion rates of about 33 and about 45 percent, respectively, of the incoming feedstock ($Q_{INPUT}$).

Thus, in this aspect, the total conversion levels of the initial feedstock, which may be but not limited to VGO, may be modified by increasing or decreasing the flowrate of the UCO to the hydrocracking zone, the hydrocracking zone conversion rate, or both. Changes to the UCO flowrate may be made as part of a continuous feedback system based on monitoring of other aspects of the system. Similarly, in some aspects, other conditions, such as the hydrocracking conditions also may be modified as part of such continuous monitoring and feedback systems.

The foregoing description of the drawing clearly illustrates the advantages encompassed by the processes described herein and the benefits to be afforded with the use thereof. It will be understood that various changes in the details, materials, and arrangements of parts and components which have been herein described and illustrated in order to explain the nature of the process may be made by those skilled in the art within the principle and scope of the process as expressed in the appended claims.

What is claimed is:

1. A process to produce low sulfur diesel and a fluid catalytic cracker (FCC) quality feedstock, the process comprising:

(a) reacting a hydrocarbonaceous feedstock in a hydrotreating zone containing a hydrotreating catalyst at conditions effective to produce a hydrotreating zone effluent having a reduced concentration of sulfur and nitrogen;

(b) separating the hydrotreating zone effluent in a fractionating zone into at least a diesel boiling range hydrocarbon stream and the FCC quality feedstock;

(c) selecting at least a first portion and a second portion of the FCC quality feedstock and combining the first portion with the diesel boiling range hydrocarbon stream to form a hydrocracking zone feed stream;

(d) reacting the hydrocracking zone feed stream in a hydrocracking zone having at least a hydrocracking catalyst at conditions effective to produce a hydrocracking zone effluent including the low sulfur diesel having less than about 10 ppm sulfur;

(e) passing the hydrocracking zone effluent into the fractionating zone to separate the low sulfur diesel; and (f) directing the second portion of the FCC quality feedstock to a fluid catalytic cracking unit.

2. The process of claim 1, wherein the hydrocracking zone is operated at a temperature from about 288° C. (550° F.) to about 454° C. (850° F.), a pressure from about 3.5 MPa (500 psig) to about 17.3 MPa (2500 psig), and a liquid hourly space velocity from about 0.1 $hr^{-1}$ to about 10 $hr^{-1}$.

3. The process of claim 2, wherein the hydrotreating zone is operated at a temperature from about 288° C. (550° F.) to about 454° C. (850° F.), a pressure from about 3.5 MPa (500 psig) to about 17.3 MPa (2500 psig), and a liquid hourly space velocity from about 0.1 $hr^{-1}$ to about 10 $hr^{-1}$.

4. The process of claim 1, wherein the first portion is about 25 to about 40 percent of the FCC quality feedstock.

5. The process of claim 4, wherein the hydrocracking zone has a conversion rate of about 70 to about 85 percent.

6. The process of claim 1, wherein the hydrotreating zone effluent and the hydrocracking zone effluent are separately fed to the fractionation zone.

7. The process of claim 6, wherein the fractionating zone comprises a divided-wall fractionator where the hydrotreating zone effluent is fractionated in a first region thereof and the hydrocracking zone effluent is fractionated in a second region thereof.

8. The process of claim 7, wherein the divided-wall fractionator includes a dividing wall arranged and configured such that admixture of the diesel boiling range hydrocarbon stream and the low sulfur diesel is substantially prevented and movement of vapor from each region to an upper end of the fractionator is permitted.

9. A process to produce a fluid catalytic cracker (FCC) quality feedstock and an ultra low sulfur diesel, the process comprising:

(a) reacting a hydrocarbonaceous feedstock in a hydrotreating zone containing a hydrotreating catalyst to produce a hydrotreating zone effluent having less than about 1000 ppm sulfur;

(b) separating the hydrotreating zone effluent in a fractionation zone into at least a diesel boiling range hydrocarbon stream and the FCC quality feedstock;

(c) combining about 25 to about 40 percent of the FCC quality feedstock and the diesel boiling range hydrocarbon stream into a hydrocracking zone feedstock;

(d) reacting the hydrocracking zone feedstock in a hydrocracking zone containing at least a hydrocracking catalyst to produce a hydrocracking zone effluent including high quality, ultra low sulfur diesel having a cetane number between about 40 and about 55 with less than about 10 ppm sulfur; and (e) passing the hydrocracking zone effluent into the fractionation zone to separate the ultra low sulfur diesel.

10. The process of claim 9, wherein the hydrocarbonaceous feedstock includes at least 50 percent hydrocarbons with a boiling range above about 371° C. (700° F.).

11. The process of claim 9, wherein the hydrotreating zone operates at a temperature from about 288° C. (550° F.) to about 454° C. (850° F.), a pressure from about 3.5 MPa (500 psig) to about 17.3 MPa (2500 psig), and a liquid hourly space velocity from about 0.1 $hr^{-1}$ to about 10 $hr^{-1}$ and wherein the hydrocracking zone operates at a temperature from about 288° C. (550° F.) to about 454° C. (850° F.), a pressure from about 3.5 MPa (500 psig) to about 17.3 MPa (2500 psig), and a liquid hourly space velocity from about 0.1 $hr^{-1}$ to about 10 $hr^{-1}$.

12. The process of claim 9, further comprising a second hydrocarbonaceous feedstock to the hydrocracking zone, wherein the second hydrocarbonaceous feedstock has a boiling range between about 343° C. (650° F.) and about 566° C. (1050° F.).

13. The process of claim 9, wherein the fractionator zone includes a divided-wall fractionator having a dividing wall to substantially prevent admixture of the ultra low sulfur diesel and the diesel boiling range hydrocarbon stream.

* * * * *